US005163205A

United States Patent [19]

Niederer

[11] Patent Number: 5,163,205

[45] Date of Patent: Nov. 17, 1992

[54] BELTED ROTARY DRAFTING DEVICE FOR STAPLE FIBERS AND METHOD

[76] Inventor: Kurt W. Niederer, 3021 Mountainbrook Rd., Charlotte, N.C. 28210

[21] Appl. No.: 751,753

[22] Filed: Aug. 29, 1991

[51] Int. Cl.[5] ..... D01H 5/70

[52] U.S. Cl. ..... 19/248; 57/315; 57/400

[58] Field of Search ..... 19/236, 243, 244, 246, 19/248, 250, 258; 57/315, 400, 402, 403, 404, 488, 411, 413, 415, 417; 28/282

[56] References Cited

U.S. PATENT DOCUMENTS

| | | | |
|---|---|---|---|
| 771,396 | 10/1904 | Sawyer | 57/312 |
| 2,574,455 | 11/1951 | Abbott | 57/34 |
| 2,780,909 | 2/1957 | Biefeld et al. | 57/315 X |
| 2,881,586 | 4/1959 | Svaty | 57/157 |
| 3,030,761 | 4/1962 | Negishi | 57/52 |
| 3,115,001 | 12/1963 | Cizek et al. | 57/408 X |
| 3,119,223 | 1/1964 | Meimberg | 57/50 |
| 3,121,306 | 2/1964 | Cizek et al. | 57/58.89 |
| 3,340,685 | 9/1967 | Vignon | 57/34 |
| 3,481,128 | 12/1969 | Landwehrkamp et al. | 57/58.89 |
| 3,501,907 | 3/1970 | Tabata et al. | 57/411 X |
| 3,834,150 | 9/1974 | Ottewell et al. | 57/156 |
| 4,202,162 | 5/1980 | Vignon | 57/411 X |
| 4,567,723 | 2/1986 | Safar | 57/409 |
| 4,759,176 | 7/1988 | Stahlecker | 57/408 X |

FOREIGN PATENT DOCUMENTS

| | | | |
|---|---|---|---|
| 2178451 | 2/1987 | United Kingdom | 57/400 |
| 9008211 | 7/1990 | World Int. Prop. O. | 19/236 |

*Primary Examiner*—Werner H. Schroeder
*Assistant Examiner*—Ismael Izaguirre
*Attorney, Agent, or Firm*—W. Thad Adams, III

[57] ABSTRACT

An apparatus for drafting a continuous strand of staple fibers into a finer strand of the staple fibers and including a mechanism for supplying separated fibers suspended in a fluid and a rotating fiber chute receiving the fluid with the separated fibers axially and dispensing the fluid and the fibers radially. A collection belt with a porous portion is used for passing the fluid but holding back the fibers wherein the belt moves in a circular path around the chute and leaves the circular path to move the collected fibers thereon out of the circular path. A vacuum housing is positioned in close proximity to the collection belt and with an opening facing the collection belt for collection of the fluid.

17 Claims, 3 Drawing Sheets

BELTED ROTARY DRAFTING DEVICE FOR STAPLE FIBERS AND METHOD

BACKGROUND OF THE INVENTION

1. Technical Field

This invention relates to a drafting apparatus and method for textile fibers. The apparatus and method has particular application for the thinning out of a bundle of staple fibers as is commonly required for the spinning process of yarn. The apparatus and method also serves to even out and to mix fibers by distributing the individual fibers from one cross section of a fiber bundle over a substantial length of a collection surface and can be used for the blending and drawing process of staple fibers.

2. Background Art

Conventional three (3) or four (4) cylinder drafting systems are very effective in thinning out a sliver or roving in order to have this fiber bundle twisted into a spun yarn. However this prior art of drafting results in an increase of the unevenness in the fiber mass. This unevenness also weakens the yarn strand and for this reason, the applied twist in the yarn strand has to be increased. This higher twist has several disadvantages. The higher twist results in lower production. It also compresses the yarn more, resulting in a smaller volume and a harsher yarn.

Prior art of drafting the fiber bundle also lack an effective mixing of the individual fibers, which is especially important with fiber conglomerates of different characteristics, as for example with a fiber blend of cotton and polyester.

The invention described below provides an effective means to even out irregularities in the fiber bundle during the drafting process. It also blends the individual fibers intrinsically, even with dissimilar properties such as different friction coefficient, stiffness, cross section, fiber length et cetera.

SUMMARY OF THE INVENTION

It is an object of the invention to improve the evenness of a drafted fiber bundle as compared to conventional drafting systems as they are applied today on draw-, roving- and on spinning-frames.

It is yet another object of the invention to improve the intermixing of fibers in a fiber bundle in fiber processing.

It is another object of the invention to lay fibers in oriented fashion onto a collection surface.

These and other objects of the invention are achieved in the preferred embodiments disclosed below by distributing separated fibers by a rotating channel inside a collection chamber.

DESCRIPTION OF PREFERRED EMBODIMENT

Figure 2:
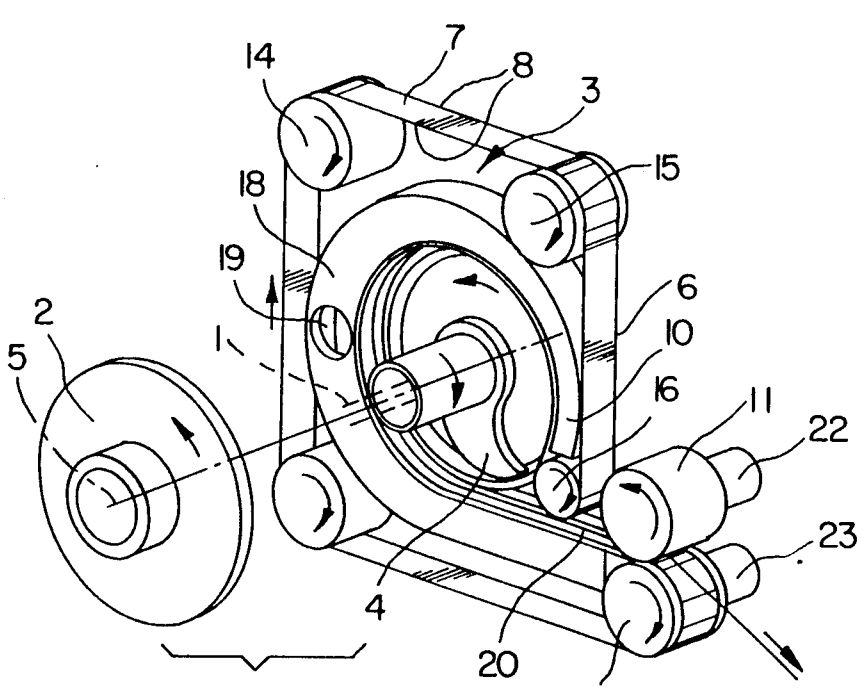
FIG. 2 is a perspective view of the drafting system according to the present invention with the front side-disk (2) removed to show the inside of the drafting housing (3).
Figure 1:
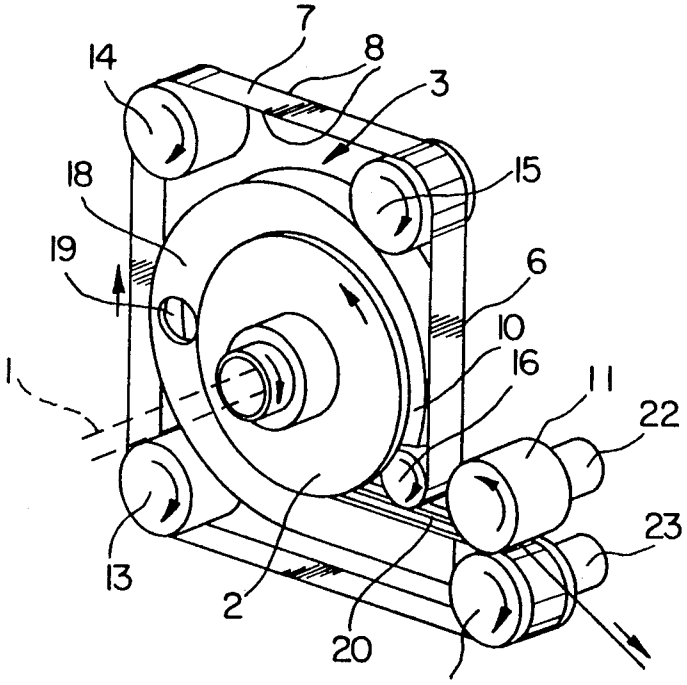
FIG. 1 is a perspective view of the drafting system according to the present invention.
Figure 3:
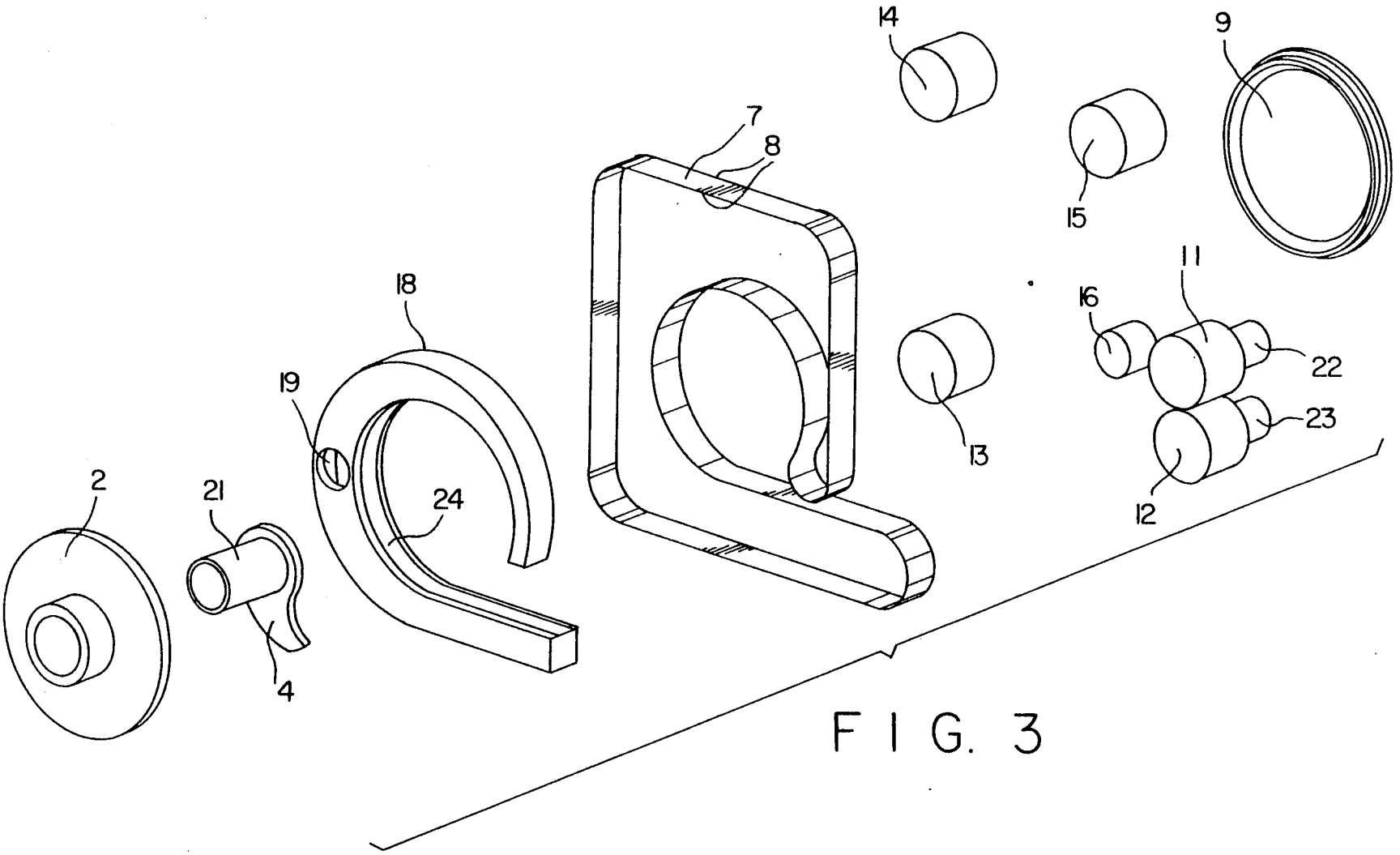
FIG. 3 is a perspective view of the present invention with the individual parts separated.
Figure 6:
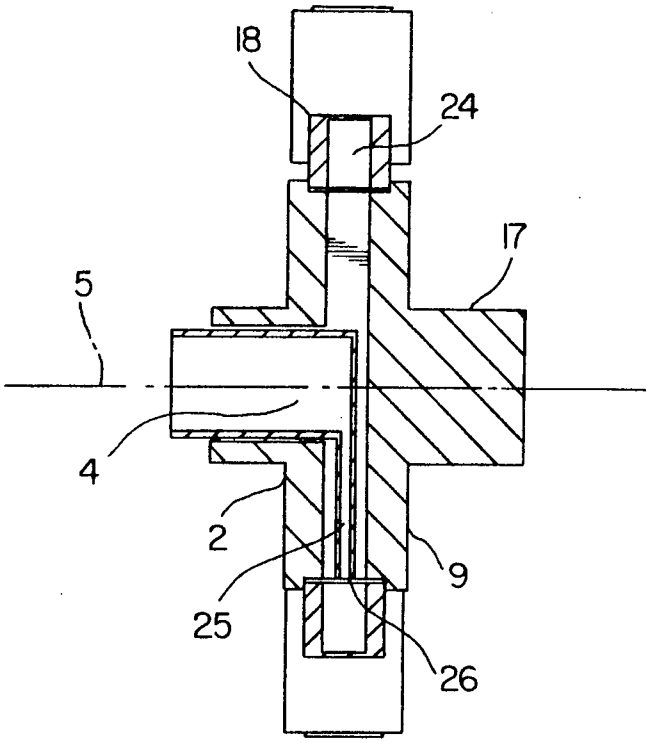
FIG. 6 is a sectional view of the present invention.
Figure 5:
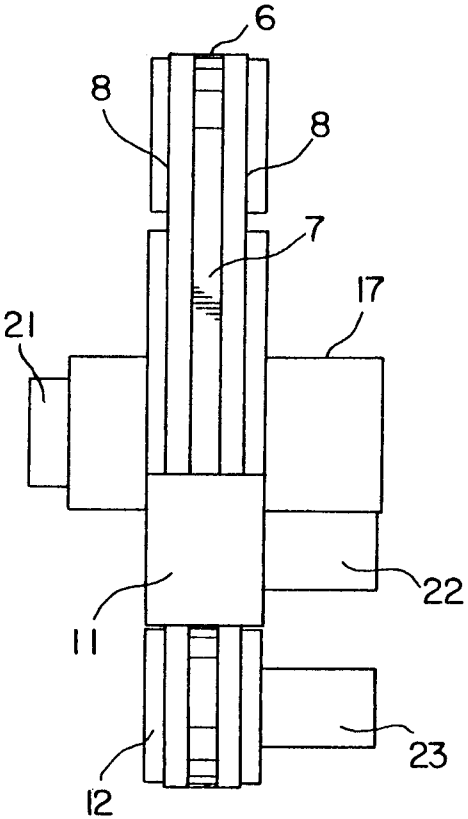
FIG. 5 is a frontal view of the present invention with the vacuum chamber (18) removed.

Referring now specifically to the accompanying drawings and initially to FIG. 1, FIG. 2 and FIG. 3, a fiber chute (4) is mounted with its chute hub (21) in line with the axis (5) of the drafting housing (3). A collection belt (6) is wrapped around the front side-disk (2) and the rear side-disk (9), whereby it is only supported on its border (8). The collection belt (6) is taken outside of the drafting chamber (10) and fed to the upper pinch roll (11) and the lower pinch roll (12). The collection belt (6) is guided around idler pulley (13), idler pulley (14), idler pulley (15), and idler pulley (16), where it enters the drafting chamber (10) of the drafting-unit. The collection belt (6) is provided with a perforated center (7) in its middle portion for the passage of a fluid. A steel tape with perforations in the middle portion could be used as a collection belt (6) as is often used on rotary screen-printing machines. The rear side-disk (9) is rotationally supported on its drive hub (17) and is driven by a drive-belt (not shown). The drafting system is rotationally supported on its axis (5) and is driven by a drive-belt (not shown). The upper pinch roll (11) is rotationally supported on its axis (22) and is driven by a drive-belt (not shown). The lower pinch roll (12) is rotationally supported on its axis (23) and is driven by a drive-belt (not shown). The idler pulley (13), idler pulley (14), idler pulley (15) and idler pulley (16) are rotationally mounted through their axis and are free to rotate. The vacuum housing (18) is mounted between front side-disk (2) and rear side-disk (9). It is provided with a vacuum chamber (24). A vacuum connection (19) is in communication with a vacuum generator (not shown), as for example a vacuum pump.

In FIG. 1 the separated fibers (1) are shown entering the fiber chute (4) through its chute axis (5). These fibers can be separated and suspended in a fluid prior to entering the fiber chute (4) in conventional manners as accomplished in the textile industry. A well suited method for the fiber separation is a high-speed combing roll (not shown) as it is commonly used in conjunction with turbine-type open-end spinning systems.

After the fibers (1) enter the drafting housing (3), the clock-wise rotating fiber chute (4) distributes the fibers (1) radially onto the perforated center (7) of the collection belt (6) as shown in FIG. 2. The vacuum in the vacuum chamber (18) generates a fluid-flow from the inside of the drafting housing (3) radially through the perforated center (7) of collection belt (6) into the vacuum chamber (18). This fluid-flow forces the fibers (1) onto the perforated center (7) of collection belt (6). The collection belt (6) is driven by a front side-disk (2) and a rear side-disk (9), as well as by the upper pinch roll (11) and the lower pinch roll (12) and is slowly moving in a counter-clockwise direction around the fiber chute (4). This motion of the collection belt (6) is feeding the collected fiber bundle (20) out of the drafting chamber (10) and through the upper pinch roll (11) and lower pinch roll (12), where it can be twisted and taken up by a spinning system, as for example a ring-spinning spindle (not shown), or is collected for further processing.

Figure 4:
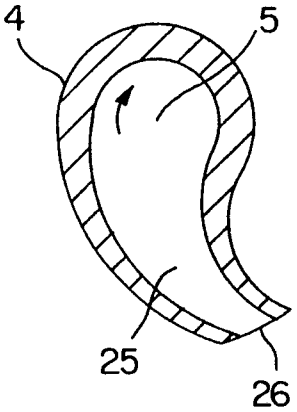
FIG. 4 is a sectional view of the fiber chute (4).

The cross-section of the fiber chute (4) in FIG. 4 shows the reduction in the width of the fiber duct (25) towards its mouth (26). This reduction in the cross-section results in an increase of the fluid velocity, hence an increase in the velocity of the fibers (1). The result is that the leading end of the fibers (1) are forced to move faster than the trailing end, which results in a straightening of the fibers (1) in the fiber chute (4).

The fast rotation of fiber chute (4) generates centrifugal force acting on the fibers (1) in the fiber chute (4). The centrifugal force on the leading end of the fibers (1) is greater than on their trailing end, since the rotational radius is larger on the leading end than on the trailing end. This difference in centrifugal force acting on the leading and trailing end of the fibers (1) in the fiber chute (4) has also a straightening effect on these fibers (1).

When the fibers (1) leave the fiber chute (4), the leading end is forced onto the perforated center (7) of the collection belt (6) by the fluid as well as by the centrifugal force. Since the fiber chute (4) rotates rapidly in clock-wise direction and the collection belt (6) moves relatively slow in the opposite direction of the fiber chute (4), the trailing end is pulled out of the mouth (26) of the fiber chute (4) at great speed and is also deposited onto the collection belt (6). This accelerated pulling on the trailing fibers (1) results in an excellent straightening effect on the fibers (1).

The short term irregularities from the fiber supply as well as irregularities generated by the fiber separation are evened out through the "doubling effect" as it is known in turbine-type Open-End spinning systems. If for example a larger than average amount of fibers is fed to this drafting system over a short time span, the fiber chute (4) is distributing this higher fiber concentration over the whole circumference of the collection belt (6) in the drafting housing (3), resulting in a spreading-out of this higher than normal fiber concentration.

It should be noted that the fibers (1) have to be well separated or bridging fibers can twist together in the fiber chute (4) before they reach the drafting housing (3). It has been found that fewer than 3 (three) to 4 (four) fibers in the cross-section through the fiber chute (4) of the fiber chute (4) are acceptable. Good fiber-separation is accomplished through sufficient air-flow caused by the pressure drop in the fluid from the chute axis (5) of the fiber chute (4) to the inside of the drafting housing (3). It is also affected by the rotational speed of the fiber chute (4), it's dimensions and shape, as well as by the required fines of the fiber bundle (20) at the exit of the drafting system.

I claim:

1. An apparatus for drafting a continuous strand of staple fibers into a finer strand of said staple fibers comprising:

(a) a mechanism for supplying separated fibers suspended in a fluid;

(b) a rotating fiber chute receiving said fluid with the separated fibers axially and dispensing said fluid and said fibers radially;

(c) a collection belt with a porous portion of passing the fluid but holding back the fibers wherein the belt moves in a circular path around said chute and leaves said circular path to move the collected fibers thereon out of said circular path;

(d) a vacuum housing in close proximity to the collection belt and with an opening facing said collection belt for collection of the said fluid.

2. The apparatus for drafting a continuous strand of staple fibers into a finer strand as claimed in claim 1 wherein said rotating fiber chute has a narrowing fluid passage to affect a straightening and aligning of the said fibers.

3. The apparatus for drafting a continuous strand of staple fibers into a finer strand as claimed in claim 1 wherein said rotating fiber chute is backwardly bent relative to the direction of rotation of the chute to affect the straightening and aligning of said fibers during the depositing of said fibers.

4. The apparatus for drafting a continuous strand of staple fibers into a finer strand as claimed in claim 1 wherein said rotating fiber chute rotates in an opposite direction as compared to said collection belt.

5. The apparatus for drafting a continuous strand of staple fibers into a finer strand as claimed in claim 1 wherein said collection belt is an endless steel tape.

6. An apparatus for blending staple fibers comprising:

(a) a mechanism for supplying separated fibers suspended in a fluid;

(b) a rotating fiber chute receiving said fluid with the separated fibers axially and dispensing said fluid and said fibers radially;

(c) a collection belt with a porous portion for passing the fluid but holding back the fibers wherein the belt moves in a circular path around said chute and leaves said circular path to move the collected fibers thereon out of said circular path;

(d) a vacuum housing in close proximity to the collection belt and with an opening facing said collection belt for collection of the said fluid.

7. The apparatus for blending staple fibers as claimed in claim 6 wherein said rotating fiber chute has a narrowing fluid passage to affect a straightening and aligning of the said fibers.

8. The apparatus for blending staple fibers as claimed in claim 6 wherein said rotating fiber chute is backwardly bent relative to the direction of rotation of the chute to affect the straightening and aligning of said fibers during the depositing of said fibers.

9. The apparatus for blending staple fibers as claimed in claim 6 wherein said rotating fiber chute rotates in opposite direction as compared to said collection belt.

10. The apparatus for blending staple fibers as claimed in claim 6 wherein said collection belt is an endless steel tape.

11. The method of laying staple fibers, comprising the steps of:

(a) providing a rotating fiber chute;

(b) separating the fibers to be layed;

(c) suspending the fibers in a fluid;

(d) introducing the fluid-entrained fibers axially into the chute;

(e) dispensing the fluid-entrained fibers radially from the fiber chute;

(f) depositing the fluid-entrained fibers dispensed from the fiber chute onto an open, cylindrically shaped collection belt; and (g) continuously removing the fibers from the collection belt.

12. The method as claimed in claim 11, comprising a moving endless belt encompassing the rotating fiber chute for almost a full revolution onto which the fibers are deposited and continuously taken out of the circular path.

13. A method of drafting a continuous strand of staple fibers into a finer strand of staple fibers comprising the steps of first separating the fibers from a fluid and then laying the fibers with a rotating fiber chute onto an open, cylindrically shaped collection belt and then removing said fibers continuously from said collection belt.

14. The method as claimed in claim 13, wherein said collection belt comprises a moving endless belt encompassing the rotating fiber chute and moving in a circular path for almost a full revolution onto which the fibers are layed and continuously taken out of the circular path.

15. The method for blending staple fibers comprising the steps of first separating the fibers from a fluid and then laying the fibers with a rotating fiber chute onto an open, cylindrically shaped collection belt and then removing said fibers continuously from said collection belt.

16. The method as claimed in claim 15, wherein said collection belt comprises a moving endless belt encompassing the rotating fiber chute and moving in a circular path for almost a full revolution onto which the fibers are layed and continuously taken out of the circular path.

17. A method of drafting a continuous primary strand of staple fibers into a blended and evened-out secondary strand of staple fibers with a rotating fiber chute onto an open, cylindrically shaped collection belt by distributing said fibers of said primary strand over a perimeter of said collection belt and then removing said secondary strand continuously from said collection tape.

* * * * *